US005416304A

United States Patent [19]

De La Cruz et al.

[11] Patent Number: 5,416,304

[45] Date of Patent: May 16, 1995

[54] MICROWAVE-REFLECTIVE DEVICE AND METHOD OF USE

[75] Inventors: Marijo S. De La Cruz, Gurnee, Ill.; Lee M. Arent, Fairfield, Ohio

[73] Assignee: Kraft General Foods, Inc., Northfield, Ill.

[21] Appl. No.: 19,466

[22] Filed: Feb. 18, 1993

Related U.S. Application Data

[63] Continuation-in-part of Ser. No. 614,005, Nov. 13, 1990, abandoned.

[51] Int. Cl.[6] ..... H05B 6/80

[52] U.S. Cl. ..... 219/730; 219/729; 219/759; 99/DIG. 14; 426/107; 426/113; 426/234; 426/243

[58] Field of Search ..... 219/10.55 E, 730, 731, 219/725, 728, 729, 731, 731, 756, 759; 426/107, 113, 234, 243; 99/DIG. 14

[56] References Cited

U.S. PATENT DOCUMENTS

| | | | |
|---|---|---|---|
| 2,612,596 | 9/1952 | Gross | 219/47 |
| 3,854,023 | 12/1974 | Levinson | 219/10.55 |
| 4,121,078 | 10/1978 | Takano et al. | 219/10.55 F |
| 4,122,324 | 10/1978 | Falk | 219/10.55 E |
| 4,190,757 | 2/1980 | Turpin et al. | 219/10.55 E |
| 4,204,105 | 5/1980 | Leveckis et al. | 219/10.55 E |
| 4,266,108 | 5/1981 | Anderson et al. | 219/10.55 E |
| 4,283,427 | 8/1981 | Winters et al. | 426/107 |
| 4,351,997 | 9/1982 | Mattisson et al. | 219/10.55 E |
| 4,644,858 | 2/1987 | Liotto et al. | 99/10.55 E |
| 4,814,568 | 3/1989 | Keefer | 219/10.55 E |
| 4,851,631 | 7/1989 | Wendt | 219/10.55 E |
| 4,865,858 | 9/1989 | Petcavich | 426/243 |
| 4,866,234 | 9/1989 | Keefer | 219/10.55 E |
| 4,874,917 | 10/1989 | Weimer | 219/10.55 M |
| 4,888,459 | 12/1989 | Keefer | 219/10.55 E |
| 4,891,482 | 1/1990 | Jaeger et al. | 219/10.55 E |
| 4,894,503 | 1/1990 | Wendt | 219/10.55 E |
| 4,904,836 | 2/1990 | Turpin et al. | 219/10.55 E |
| 4,926,020 | 5/1990 | Atwell et al. | 219/10.55 E |
| 4,927,991 | 5/1990 | Wendt | 219/10.55 E |
| 4,934,829 | 6/1990 | Wendt | 374/45 |
| 4,965,424 | 10/1990 | Bagley | 219/10.55 E |
| 4,972,059 | 11/1990 | Wendt et al. | 219/10.55 E |
| 4,990,735 | 2/1991 | Lorenson et al. | 219/10.55 E |
| 4,992,638 | 2/1991 | Hewitt et al. | 219/10.55 E |
| 5,028,754 | 7/1991 | Chiba | 219/10.55 E |

FOREIGN PATENT DOCUMENTS

| | | |
|---|---|---|
| 38752 | 2/1985 | Australia . |
| 0161739 | 11/1985 | European Pat. Off. . |
| 0206811 | 12/1986 | European Pat. Off. . |
| 0383516 | 8/1990 | European Pat. Off. . |
| 2199235 | 6/1988 | United Kingdom . |
| WO88/03352 | 5/1988 | WIPO . |
| WO89/08373 | 9/1989 | WIPO . |

OTHER PUBLICATIONS

"The Why's and How's of Mathematical Modelling for Microwave Heating", Lorenson, *Microwave World,* vol. 11, No. 1–Spring, 1990, pp. 14–23.

"The Modelling of Foods as Resonators, in Predicting Microwave Heating Performance," Keefer, 22nd Annual Microwave Symposium of the International Microwave Power Institute, Cincinnati, Sep. 1, 1987, 28 pages.

*Primary Examiner*—Bruce A. Reynolds
*Assistant Examiner*—Tu Hoang
*Attorney, Agent, or Firm*—Fitch, Even, Tabin & Flannery

[57] ABSTRACT

A microwave-reflective device and method for enhancing microwave heating of food items. The microwave-reflective device comprises an upstanding, microwave-reflective wall. During cooking, the microwave-reflective device is maintained about the periphery of the food item, while the space inward and above the wall may be maintained free of obstructions to microwave radiation. A susceptor film may be employed beneath the food item during heating.

20 Claims, 10 Drawing Sheets

MICROWAVE-REFLECTIVE DEVICE AND METHOD OF USE

This is a continuation-in-part of co-pending application Ser. No. 614,005, filed Nov. 13, 1990.

BACKGROUND OF THE INVENTION

1. Field of the Invention .

The invention relates generally to microwave heating of food items, and more particularly to a device for modifying the pattern of microwave radiation in a microwave oven cavity.

2. Description of Related Art

One of the problems associated with the use of microwave energy (i.e., electromagnetic radiation at a frequency of about 0.3 to 300 GHz) for cooking of food items in microwave ovens is nonuniformity of heating of the food items. Substantial temperature gradients may be present where uniformity of temperature is desired. The problem is in part due to the fact that power distribution in the oven cavity is typically non-uniform. The non-uniform power density gives rise to "hot spots" and "cold spots" within the cavity. Also contributing to the problem is the fact that a food item generally does not exhibit uniform temperature response to microwave radiation throughout its volume during a typical heating cycle. In particular, when a frozen food item is subjected to microwave radiation, certain portions of the item melt or thaw before other portions, and thawed portions absorb energy at a higher rate than frozen portions. Thus, the initial melting of a portion of the item results in a disproportionately high level of microwave energy absorption by the thawed portion, often resulting in severe overcooking of the thawed region, while other portions of the product remain frozen or undercooked.

Numerous efforts have been made to address the problem of uniformity of heating. Various types of susceptors, reflectors, and shields have been proposed as solutions. However, the utility of such devices has generally been limited. Devices which are useful in certain commercially available microwave ovens may not exhibit acceptable performance in other ovens, due to variations in power, cavity size and field configuration. Similarly, devices which enhance cooking of particular food items may provide little or no benefit in cooking other food items having different dielectric properties or different coefficients of thermal resistivity. Also, some devices which may improve cooking are unacceptable due to their tendency to cause arcing, sparking and/or combustion in the oven cavity. Furthermore, devices which shield a food item and/or reflect radiation away from the food item may increase the cooking time of the food item.

Typical food items have non-homogenous thermal resistivity and non-homogenous dielectric properties. Furthermore, the dielectric properties of such items often vary during cooking. These factors tend to further complicate efforts to improve cooking rate and uniformity.

One specific problem which has been addressed by various prior efforts is the cooking of frozen pizzas in microwave ovens. In the past, one approach to the problem has been to package the frozen pizza in a box which includes a susceptor film. The susceptor film may be dimensioned to correspond to the shape of the crust, and the crust of the pizza is placed on the susceptor film during microwave cooking. The susceptor film is intended to provide conductive heat transfer to the bottom of the crust, thereby browning and crisping the crust. However, it has been found that even with the use of susceptor films, uniformity of cooking of frozen pizzas remains difficult to obtain. The degree of difficulty varies somewhat from oven to oven, but typically, the center of the pizza remains at a lower temperature than the periphery of the pizza throughout the cooking cycle. Wide variations in temperature between points adjacent the periphery and points near the center of the pizza have been observed at the end of recommended cooking time for commercially available frozen pizzas.

U.S. Pat. No. 4,927,991 describes a grid for use in combination with a susceptor film. Example 13 of this patent describes use of the grip in combination with a French bread pizza product. The patent states that improved crispening of the crust was obtained, but that cooking time was increased by 15 seconds.

U.S. Pat. No. 4,266,108 discloses a microwave heating device in the form of a plate having a food product supported thereon, with shielding disposed over the food product, so that cooking of the food product is accomplished substantially totally by heat transferred to the food product from the plate.

U.S. Pat. No. 4,190,757 discloses a pizza package having a conductive metal foil shield bonded to the inside surface of the cover flap. The shield does not totally shield the food product contained in the package, but instead acts as a partial shield. Transmission is accomplished through openings of a predetermined size.

U.S. Pat. No. 4,904,836 discusses susceptors used to heat frozen pizzas in Example 7.

International Publication No. WO89/08373 discloses grids disposed above and below a food item such as a frozen hamburger patty, and also discloses at page 74 a conductive ring provided adjacent to and in close proximity with an outer edge of a food product. The application states that the conductive surface surrounding the food product preferably forms an electrically continuous loop around the food product. The application further states that a conductive ring may be used in combination with a grid or iris, and that the spacing of the conductive ring from the edges of the food product should preferably be about 0.75 in. or less.

U.S. Pat. No. 4,934,829 discloses a container for use in a microwave oven with a particular type of food product comprising a baked good topped with ice cream and a layer of sauce between the ice cream and the baked good. The top and sidewall of the container are shielded by foil stock, except for a lower portion of the sidewall which is unshielded to enable transmission of energy to the baked good.

It is a general object of the invention to provide improved methods and means of cooking frozen pizzas and other food products in microwave ovens. Further objects of the invention will become apparent below.

SUMMARY OF THE INVENTION

In accordance with the invention there is provided an improved method and apparatus for use in microwave heating of food items, wherein a device comprising an upstanding wall of microwave-reflective material is disposed about the periphery of the food item within the microwave oven cavity. The device may be employed in combination with a susceptor film supporting the food item, and without any additional reflectors, shields, or the like located above the food item. The device has been found to improve the rate and uniformity of heating of food items in various applications. In particular, in heating of frozen pizzas, the device has been found to shorten cooking time and provide improved uniformity even without rotation of the pizza during cooking.

In one embodiment of the invention, the major horizontal dimension of the device is selected to provide for nodes of a horizontally oriented standing wave to be substantially coincident with the upstanding wall. In one example of this embodiment, the food item is dimensioned to fit closely within the upstanding wall, and the upstanding wall has a major horizontal dimension substantially equal to a half-integer multiple of the wavelength of the electromagnetic radiation transmitted through the food item.

In accordance with another aspect of the invention, the upstanding wall may be sloped inward, defining an angle of between about 0° and about 15° with the vertical.

In accordance with another aspect of the invention, the device may be incorporated into a package for the food item, attached to a sidewall of the package, or may be included in a package as a separate article to be assembled by the consumer.

Further features and embodiments of the invention are disclosed in the Detailed Description below.

DETAILED DESCRIPTION OF PREFERRED EMBODIMENTS

The invention is generally embodied in a device and method for modifying the distribution of electromagnetic energy in a microwave oven cavity to enhance the rate and uniformity of microwave heating of a food item. The device generally comprises an upstanding wall of microwave-reflective material such as aluminum foil or an aluminum mesh which is disposed about the periphery of the food item with in the microwave oven cavity. The device may be employed in combination with a susceptor film supporting the food item. The device is preferably employed without any additional reflectors, shielding or susceptors located above the food item. Use of the device in this manner has been found to enhance both rate and uniformity of cooking of certain frozen food items disposed within the wall. In some embodiments of the invention, the device is incorporated as part of a package, and specifically, the upstanding microwave-reflective wall is incorporated in the sidewall of a package. In such packages, the top and bottom walls may be nonconductive so as to be substantially transparent to microwave energy. Thus, in such embodiments, the upper and lower walls may be made of a suitable paperboard material.

Figure 1:
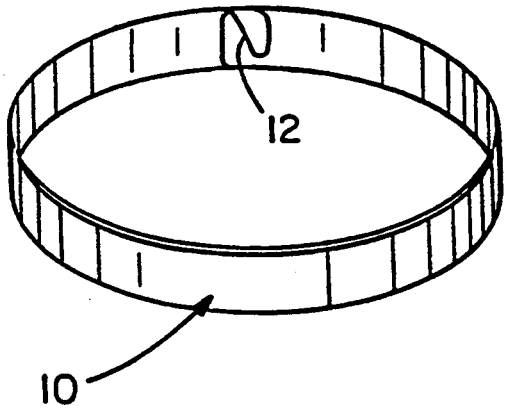
FIG. 1 is a perspective view of a device in accordance with the invention.

In a first embodiment of the invention, illustrated in FIG. 1, the device takes the form of an upstanding wall of microwave-reflective material having a circular cylindrical configuration. Devices having such a cylindrical shape have been tested with a pizza having a diameter of about 17 cm. and thickness of about 2.2 cm., disposed on a conventional susceptor. The most preferred device for a pizza of these dimensions has a wall diameter of 21 cm. and height of 6.6 cm. While these dimensions are believed to be optimal, enhanced performance has been found in cooking pizzas of this size with walls of other dimensions from 18 cm. to 25 cm. in diameter and 1.1 cm. to 6.6 cm. in height. Enhanced performance has also been achieved in tests involving pizzas of 9 in. (23 cm.) diameter, using a device having a height of 5 cm. and a diameter slightly larger than that of the pizza, with a susceptor as described above. As illustrated in FIG. 1, the device in accordance with this embodiment may be made from a strip of aluminum foil 10 having complementary slits 12 formed adjacent its opposite ends to enable the ends to be joined to form the strip into a substantially circular, cylindrical upstanding wall.

Figure 2:
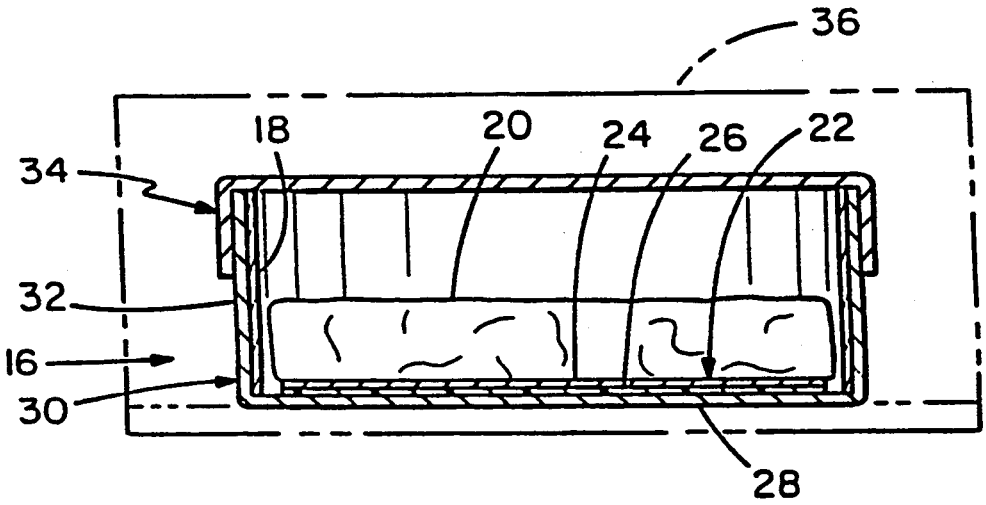
FIG. 2 is a sectional elevational view of a package embodying a device in accordance with the invention.

In a second embodiment of the invention, illustrated in FIG. 2, there is provided a package 16 which includes a generally cylindrical wall 18 of microwave-reflective material disposed about the periphery of a frozen pizza 20. The reflective material in this embodiment may be aluminum foil. The pizza 20 is supported on a susceptor assembly 22 of conventional design. The illustrated susceptor assembly includes a thin film 24 of aluminum on a polyester substrate 26, laminated to a cardboard backing member 28 which forms the bottom wall of a cardboard lower member 30 of the package 16. The polyester substrate is more preferably positioned over, rather than under, the aluminum layer, as is known in the art. The bottom wall 28 has a generally circular periphery with a substantially circular cylindrical integral cardboard sidewall 32 extending upward therefrom, and a generally circular lid 34 configured to fit over the lower member 30 to enclose the food product. The microwave-reflective foil wall 18 may be laminated to the interior of the cardboard sidewall 32 of the container, so that the food item 20 can be heated in a microwave oven cavity (shown in phantom at 36) in the package, as illustrated in FIG. 2, with or without the lid being removed. In the alternative, the microwave-reflective device 18 and the susceptor may be removable from the container so that the lower member 30 of the container may be inverted to provide a platform for cooking of the food item with the susceptor and reflective device placed thereon. The lower cardboard member 30 and cardboard lid 34 are substantially microwave transparent.

Figure 3:
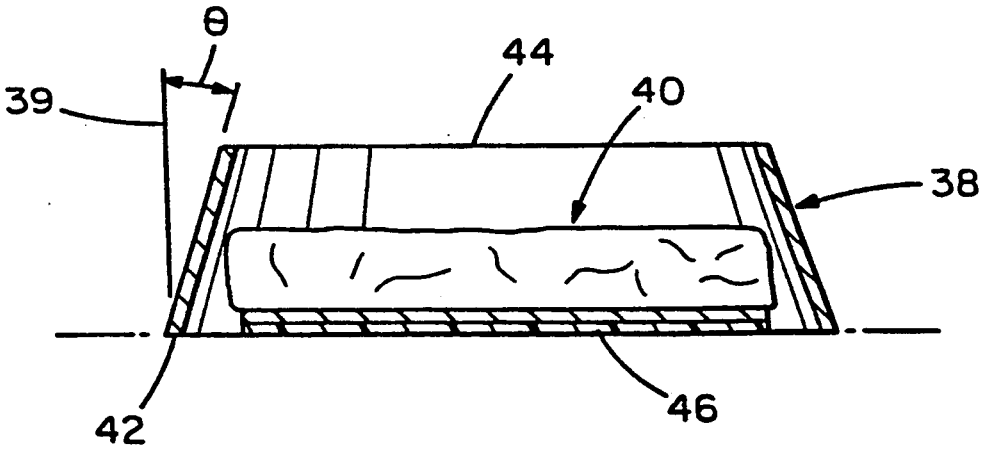
FIG. 3 is a sectional elevational view of a device in accordance with a second embodiment of the invention.

In a third embodiment of the invention, illustrated in FIG. 3, there is provided a reflective device 38 substantially similar to the device 10 of the first embodiment, except that the device 38 is provided with a frustoconical shape, rather than a cylindrical shape, with the sides sloping inward relative to a vertical axis 40 at an angle e of between 2.5° and 15°. A susceptor 46 is provided to transfer heat to the bottom surface of the pizza 40. In a particularly preferred configuration, the frustoconical device is employed in combination with a frozen pizza 40 of about 17 cm. diameter and thickness of about 2.2 cm., and the device has a diameter at its lower edge 42 of about 18.3 cm., a diameter at its upper edge 44 of about 15.7 cm., and a height of 5 cm. with the wall sloped at about 15° inward from vertical.

Figure 4:
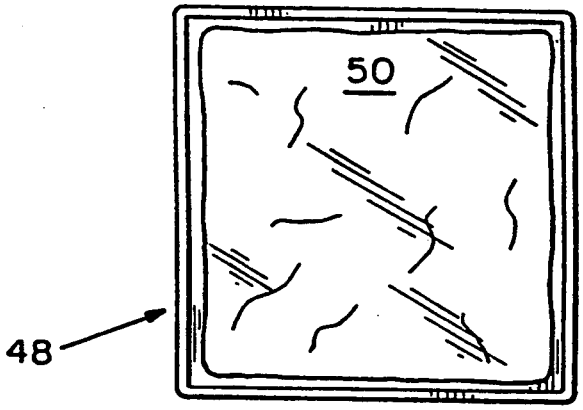
FIG. 4 is a plan view of a device in accordance with a third embodiment of the invention.

A further embodiment of the invention, illustrated in FIG. 4, comprises a reflective device 48 having a substantially square configuration as viewed in plan. The device 48 surrounds a substantially square frozen food item 50 at close proximity to the periphery thereof. The device of FIG. 4 has been successfully tested in conjunction with Budget Gourmet® "oriental rice with vegetables" entrees having a height of about 4 cm., and horizontal dimensions of about 10 cm., and with the height of the device 48 being substantially the same as that of the frozen food item. No susceptor was employed.

Figure 6:
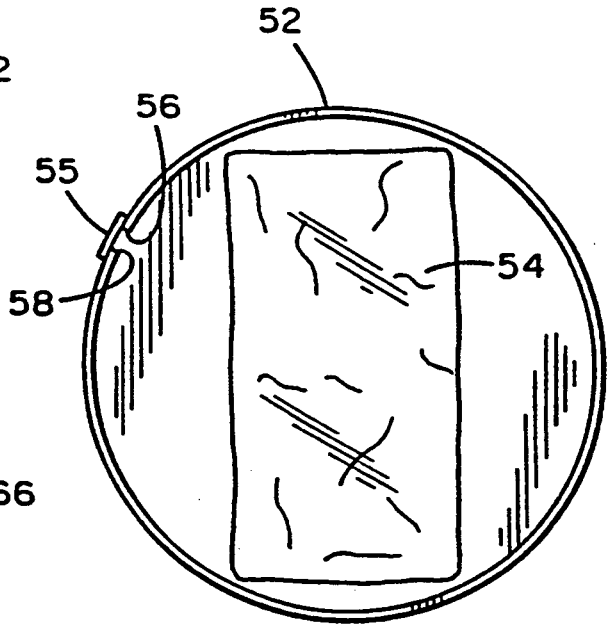
FIG. 6 is a plan view of the device of FIG. 5, shown in its assembled configuration.

In a fifth embodiment of the invention, illustrated in FIG. 6, there is provided a device 52 in the configuration of a circular cylindrical wall, surrounding a substantially rectangular food item 54. The circular cylindrical configuration of the device 52 has been successfully tested with a Budget Gourmet® chicken fettucine frozen dinner entree having horizontal dimensions of about 15 cm. by 13 cm., and a height of about 4 cm., in combination with a device having a diameter of about 25 cm. and a height of about 4.5 cm.

The reflective device 52 comprises a strip of aluminum foil having a short length of adhesive tape 55 joining the ends 56 and 58 of the strip. The device may be configured with a gap between the adjacent ends 56 and 58 of the strip, which may aid in prevention of undesirable sparking or arcing.

Figure 5:
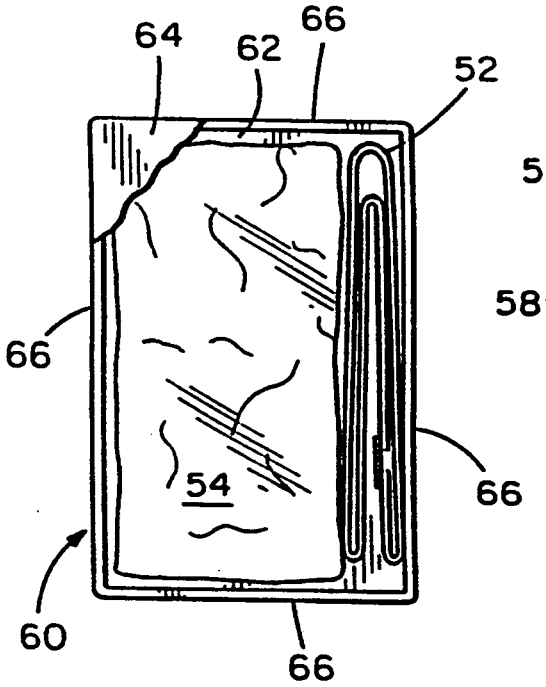
FIG. 5 is a plan view of an item in accordance with a further embodiment of the invention, with a device in accordance with the invention shown in a folded configuration as part of a package.

FIG. 5 illustrates the device 52 of FIG. 6 incorporated in a package 60 in a folded configuration. The package comprises a standard cardboard box container having rectangular top and bottom walls 62 and 64 joined by upstanding sidewalls 66 having a height slightly greater than that of the food item. The food item 54 may be contained within a separate plastic tray (not shown) within the cardboard box.

In accordance with a further embodiment of the invention, as illustrated in FIGS. 13–17, there may be provided a plurality of separate segments or panels of microwave-reflective material 68 attached to the exterior of a microwaveable paperboard container 70. The paperboard container 70 shown in FIGS. 13–17 is of a conventional design which is known in the art. The panels 68 are preferably positioned to provide gaps 71 between ends of adjacent panels. As in the embodiment of FIG. 4, the wall of microwave-reflective material in the embodiment of FIGS. 13–17 closely surrounds the frozen food item.

The container 70 of FIGS. 13–17 has a removable cover or top wall 72, a bottom wall 74, a pair of front and rear side walls 76 and second pair of substantially parallel side wall 78. The side walls 76 and 78 slope outward at an angle of about 5° to 15°; and flare outward along their upper edges to form a substantially horizontal lip 80 which forms a seal with the top wall 72 about its periphery. The bottom wall 74 and side walls 76 and 78 preferably comprise a one-piece tray, and the top wall 72 preferably is generally planar and is attached to the lip 80 by appropriate means such as a polymeric sealant, a heat seal coating, or an adhesive. The periphery of the top wall 72 is generally aligned with the periphery of the lip 80 of the container, except for an overhang 82 which projects beyond the lip 80 along one edge of the top wall 72 to facilitate peeling of a corner of the top wall 72 upward, away from the lip 80.

In the embodiment of FIGS. 13–17, the panels 68 comprise strips of aluminum foil attached by an adhesive to the exteriors of the side walls 76 and 78. In other embodiments, panels of microwave-reflective material may be attached to interior surfaces of the side walls, or sandwiched between interior and exterior layers of laminated side walls. In further embodiments, a film material covering the bottom and sides of the tray may be metallized in appropriate regions to provide microwave reflectivity in such regions.

In the embodiment of FIGS. 13–17, each of the panels comprises a strip or segment which is spaced from adjacent strips at opposite ends to provide gaps between adjacent segments. The side walls 76 and 78 are substantially planar, except that the ends of the side walls 78 adjacent the corners have triangular overlap regions. The panels 68 may function as labels, and may be printed with appropriate graphics, if desired. In the illustrated embodiment, the panels may be applied after the container 70 has been formed. In alternative embodiments, application may take place prior to assembly of the container, on a paperboard blank. In still other embodiments, the panels may be combined into a single structure without gaps between the panels 68, and the resulting structure may, if desired, be a reusable structure which is supplied separately from the package.

In the embodiment of FIGS. 13–17, the package preferably has no microwave-reflective materials or microwave-shielding materials in the top wall 72, so that the space in the microwave oven above and inward of the side walls 76 and 78 is essentially transparent to microwave energy during heating of the food product in the package.

In the embodiment of FIGS. 13–17, the distance between front and rear sidewalls 76 is about 11.5 cm at the bottom of the walls and about 12.5 cm. at the top of the walls.

The distance between sidewalls 78 is about 15 cm. at the bottom of the container 70 and about 16 cm. at the top of the container. The height of the container is about 3.5 cm. The container is intended to hold a frozen dinner which may contact the interior surfaces of the respective sidewalls 76 and 78, and bottom wall 74. The cover or top wall 72 is preferably made of a paperboard material which is substantially transparent to microwave energy, and accordingly the top wall may be left in place, with one corner lifted as described above, during application of microwave radiation to the package and food product contained therein.

Microwave-reflective materials which have been found suitable for use in some of the above-described embodiments of the invention include mesh materials as well as aluminum foil. A particular mesh material which has been found suitable for construction of reflective devices in accordance with the invention is an aluminum mesh having a nominal thickness of 0.004 in., with the mesh having a lattice—parallelogram configuration. The mesh is comprised of strands having a width of about 0.008 in., and configured such that the major dimension of a parallelogram defined by intersecting pairs of adjacent strands is about 0.008 in. Tests of this material have indicated a reflectance of about 94% of microwave radiation.

Aluminum foil has been found to exhibit similar reflectance. It is believed suitable for construction of devices in accordance with the invention. Success has been achieved in tests employing aluminum foil having thicknesses of between about 0.0006 in. (0.0015 cm.) and about 0.0012 in. (0.003 cm.). It should be noted that in FIG. 2, as well as in subsequent figures, the foil, susceptor film components, etc. are drawn disproportionately thick for purposes of illustration.

Figure 7:
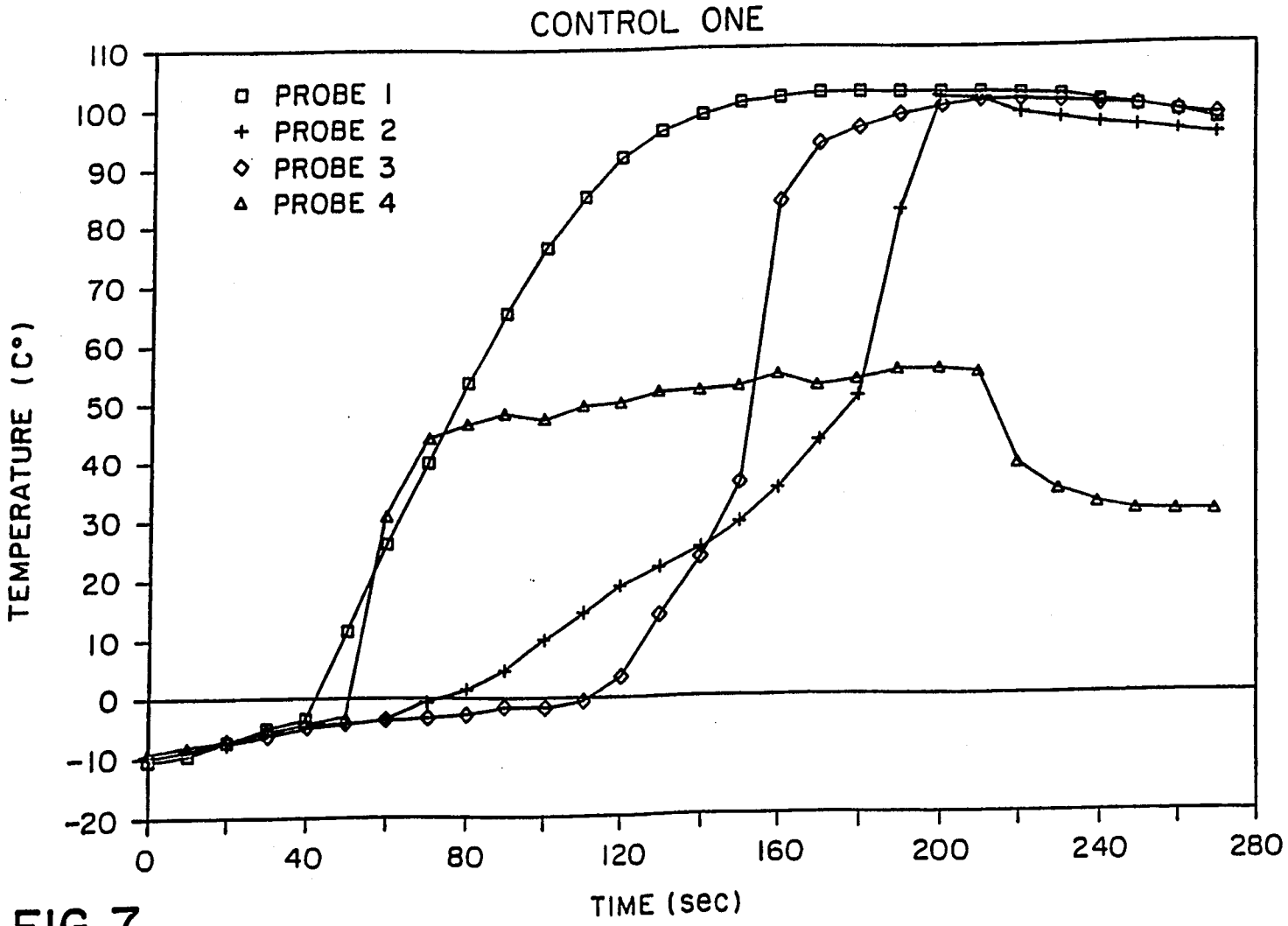
FIG. 7 is a plot of temperature as a function of time, at four points in a food item being cooked in a microwave oven cavity, in a first control example.
Figure 8:
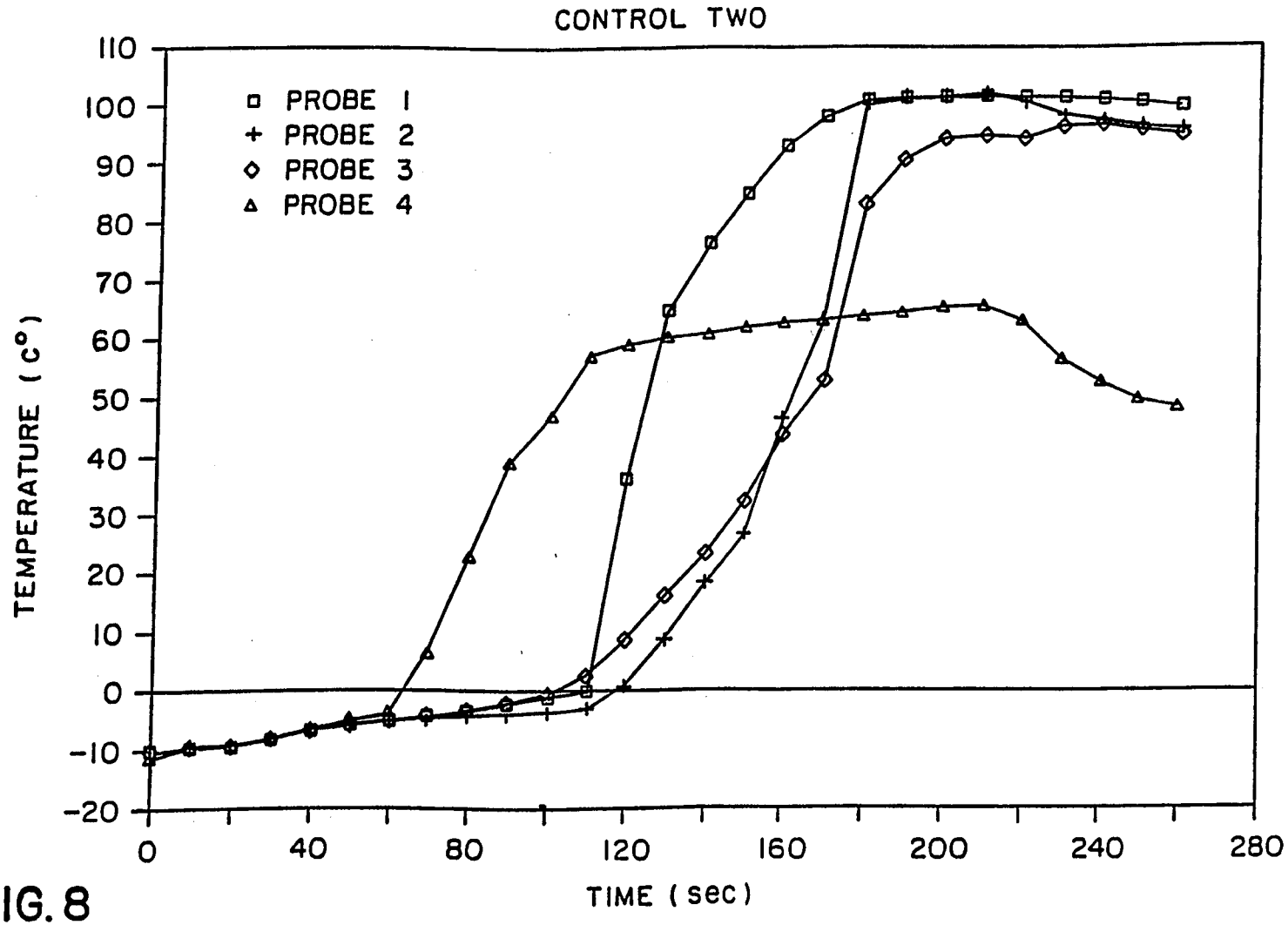
FIG. 8 is a plot similar to that of FIG. 7 for a second control example.

Advantages obtained through the use of methods and apparatus in accordance with the invention may be appreciated by comparison of the temperature/time plots of FIGS. 9–12 with those of FIGS. 7 and 8. FIGS. 7 and 8 represent "control" examples, whereas FIGS. 9–12 represent results obtained using devices in accordance with the invention. In each test, four probes were inserted into the top surface of a frozen pizza (17 cm. diameter) with probes 1 and 4 being at diametrically opposite locations adjacent the periphery; probe 2 being located in the center; and probe 3 located approximately midway between probe 2 and probe 4. All temperatures are in °C.

Figure 9:
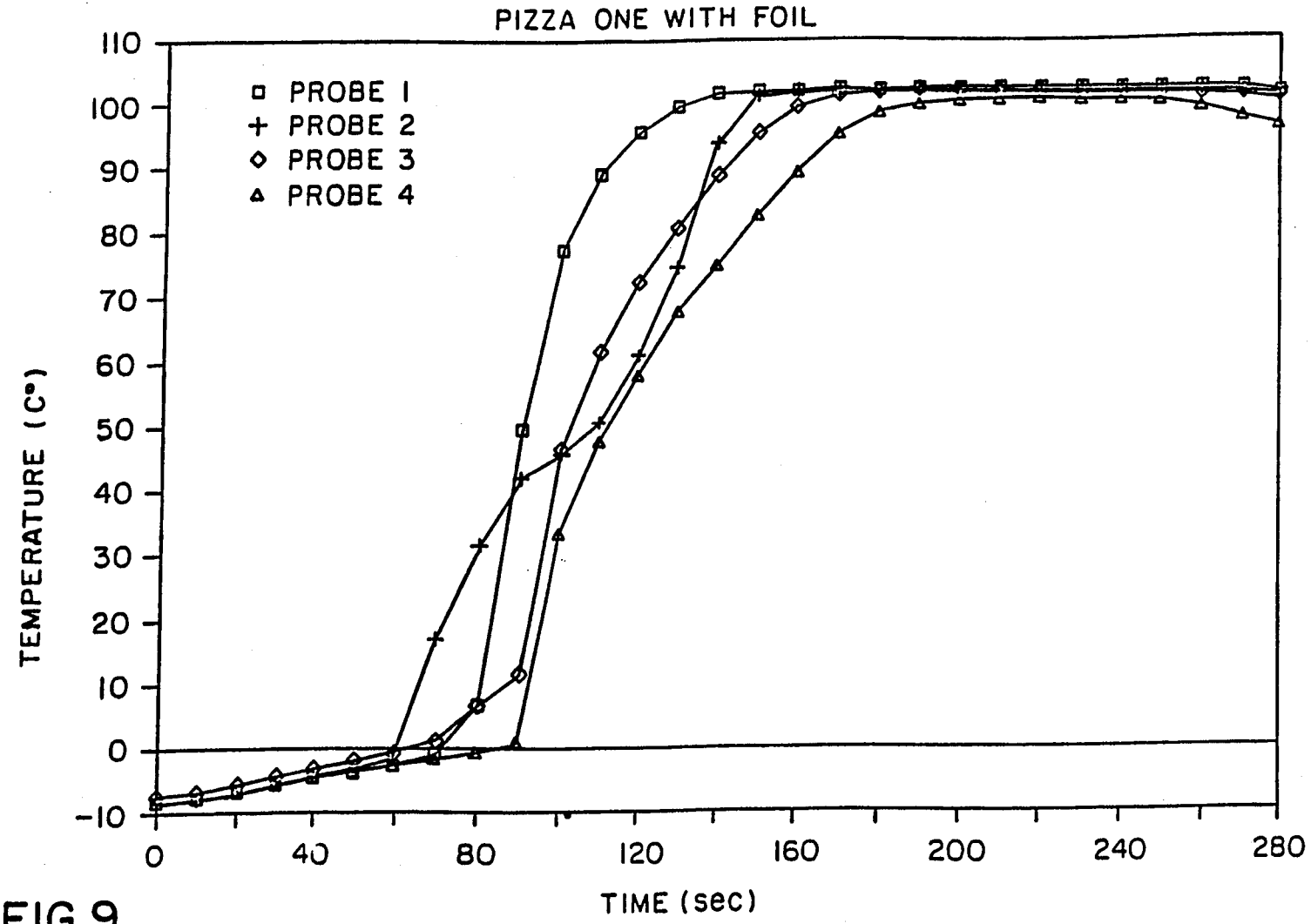
FIG. 9 is a plot similar to that of FIG. 7, showing temperature as a function of time when a foil device in accordance with an embodiment of the invention was employed.
Figure 10:
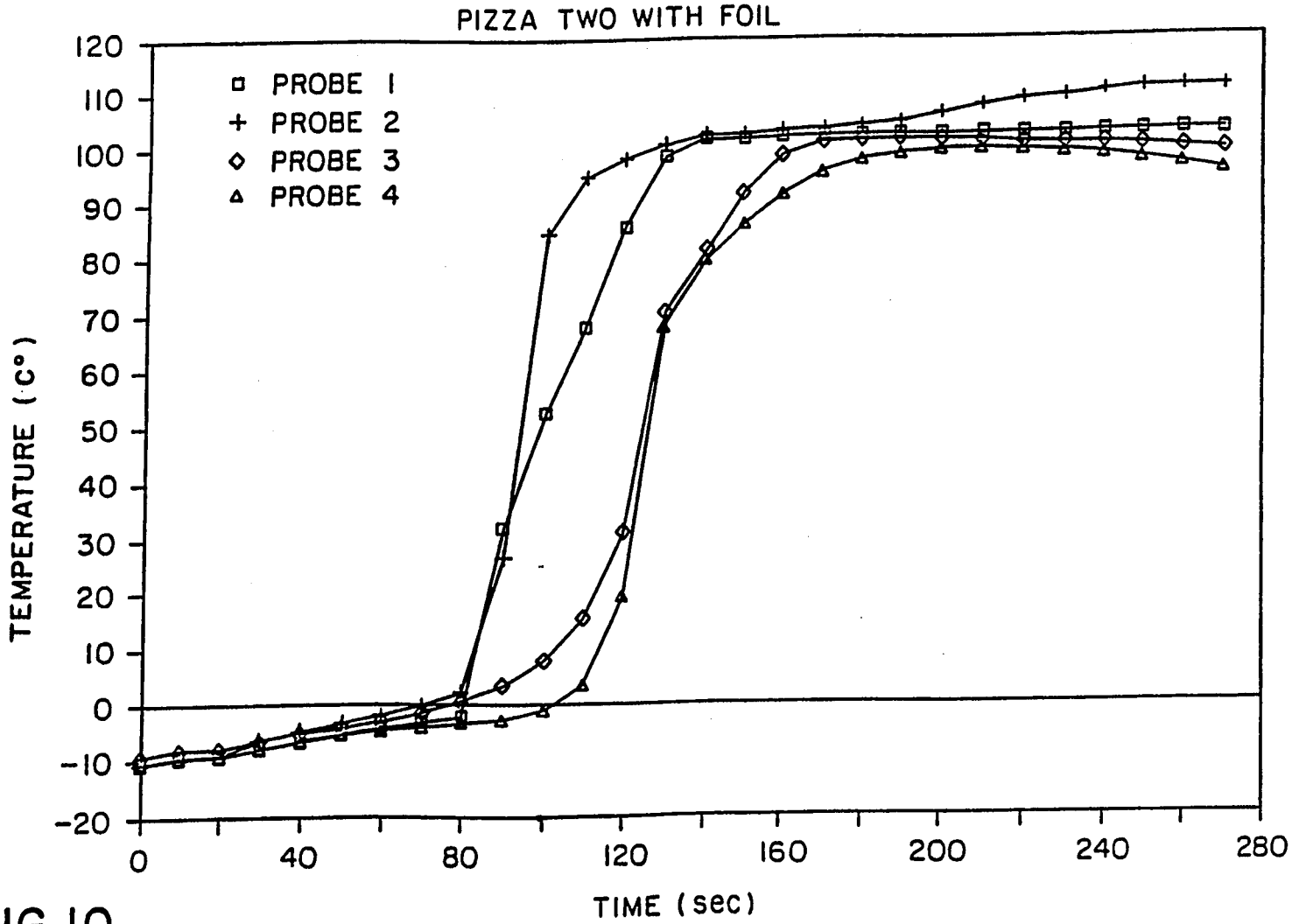
FIG. 10 is a plot similar to that of FIG. 9, illustrating results obtained in a second trial employing the foil device.
Figure 11:
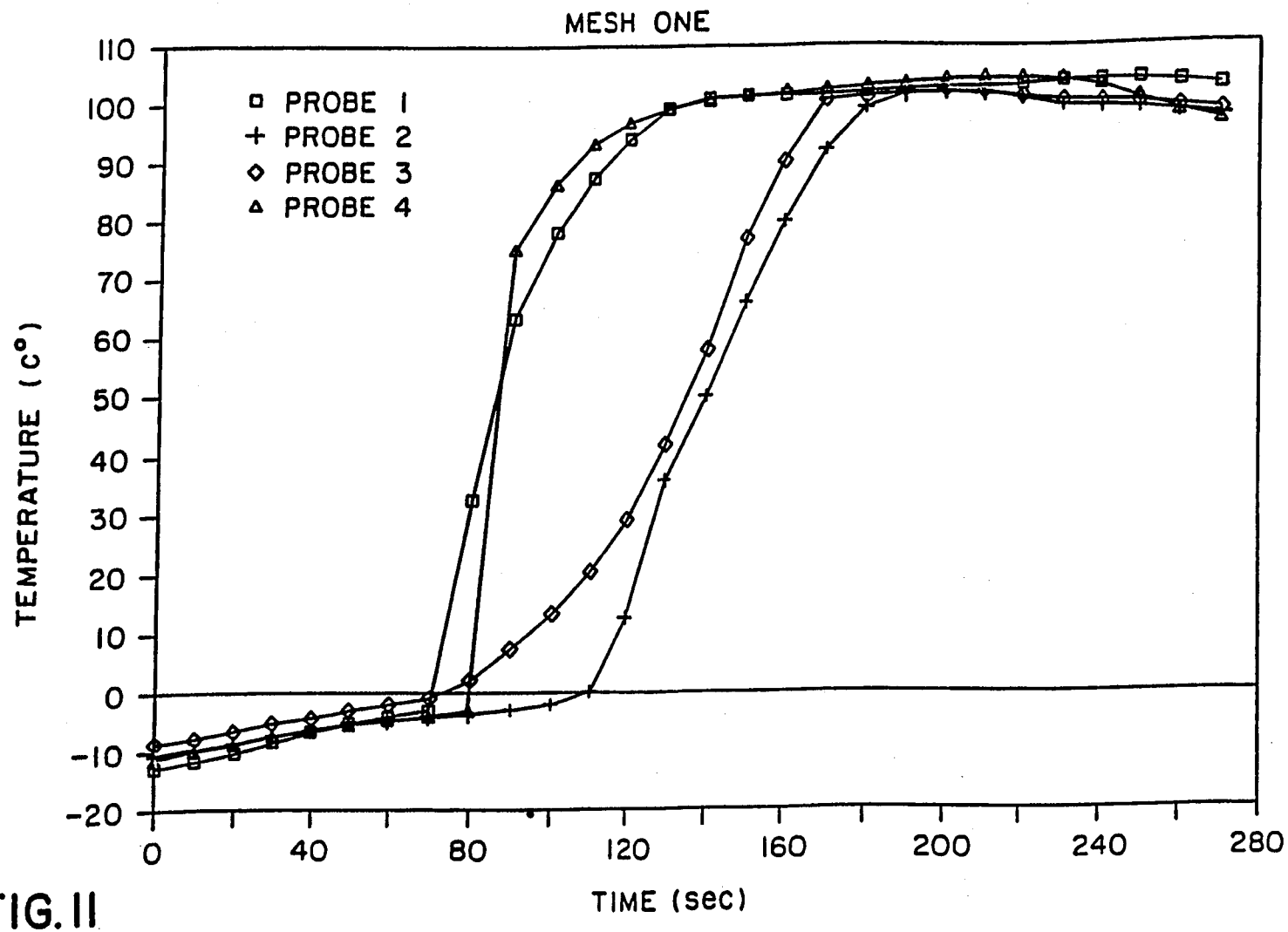
FIG. 11 is a plot similar to that of FIG. 7, illustrating results obtained with a mesh device in accordance with an embodiment of the invention.
Figure 12:
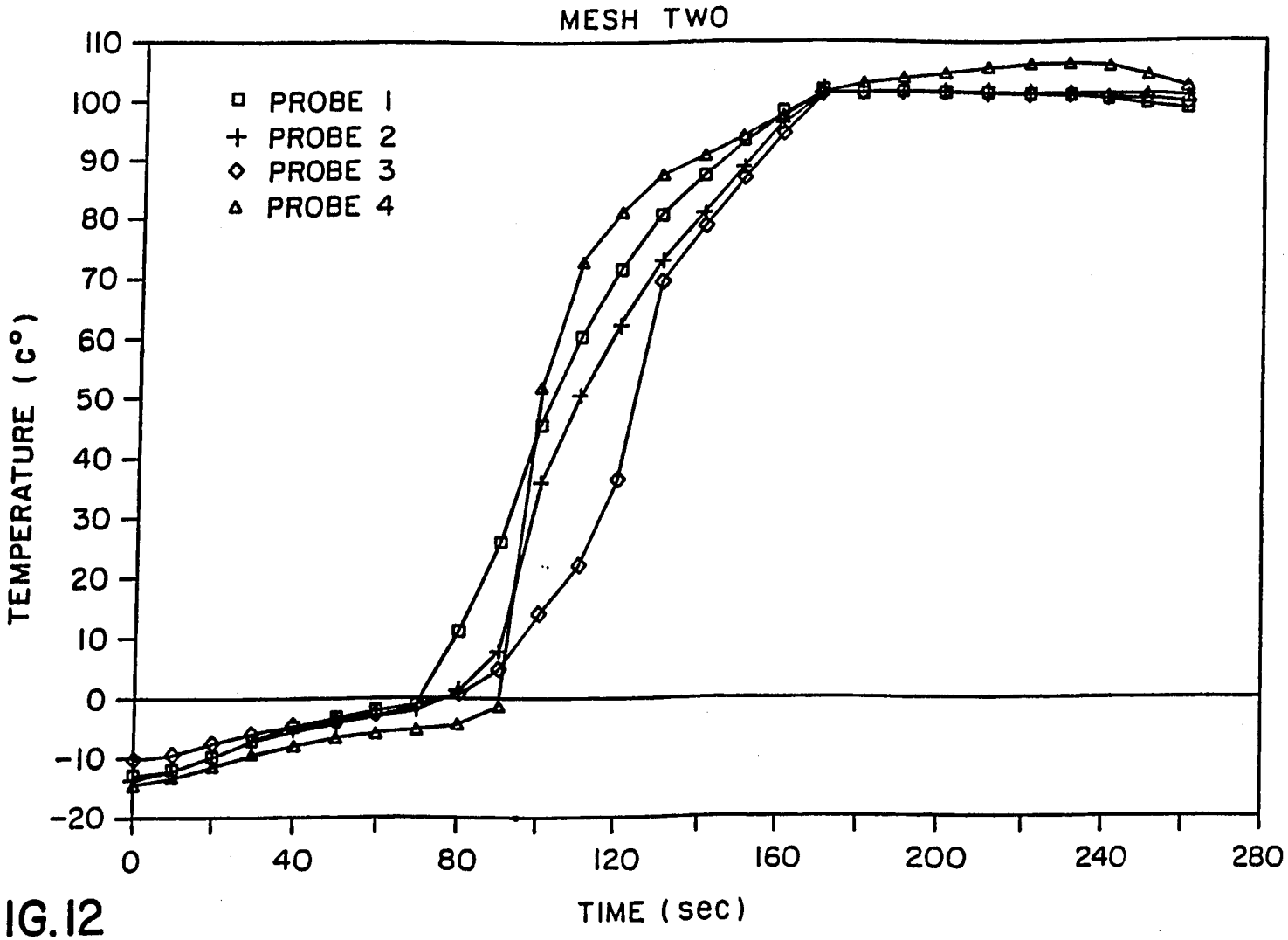
FIG. 12 is a plot similar to that of FIG. 11, showing results obtained in a second trial employing the mesh device.
Figure 13:
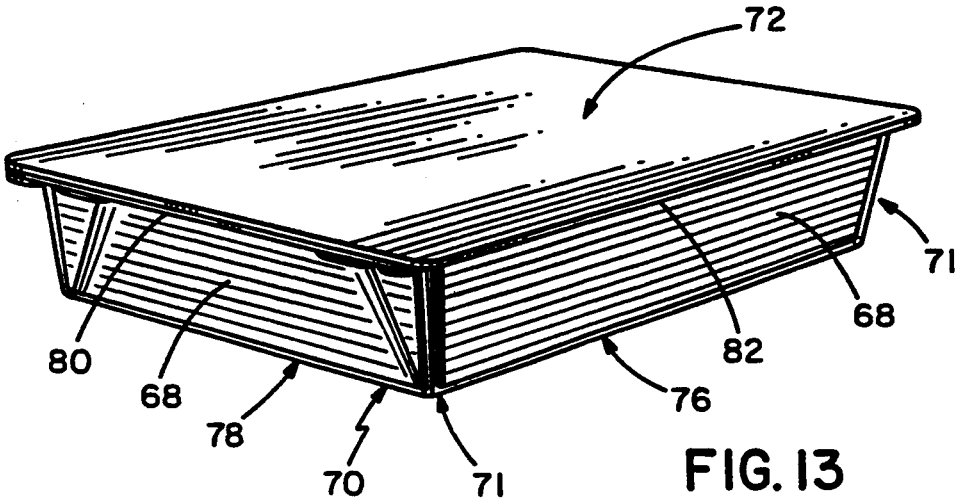
FIG. 13 is a perspective view of a package in accordance with a further embodiment of the invention.
Figure 14:
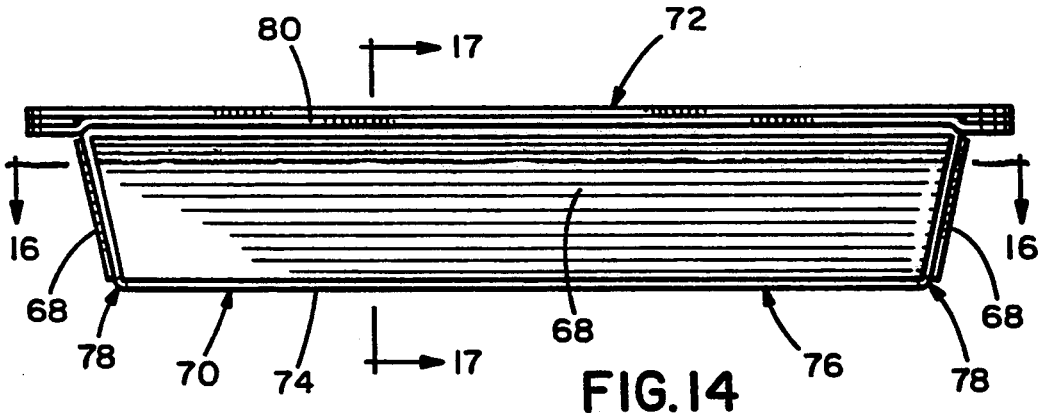
FIG. 14 is a front elevational view of the package of FIG. 13.
Figure 15:
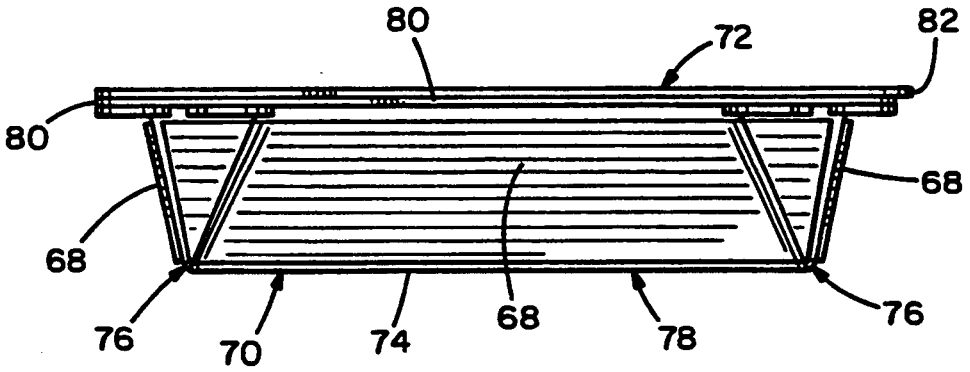
FIG. 15 is a side elevational view of the package of FIG. 13.
Figure 16:
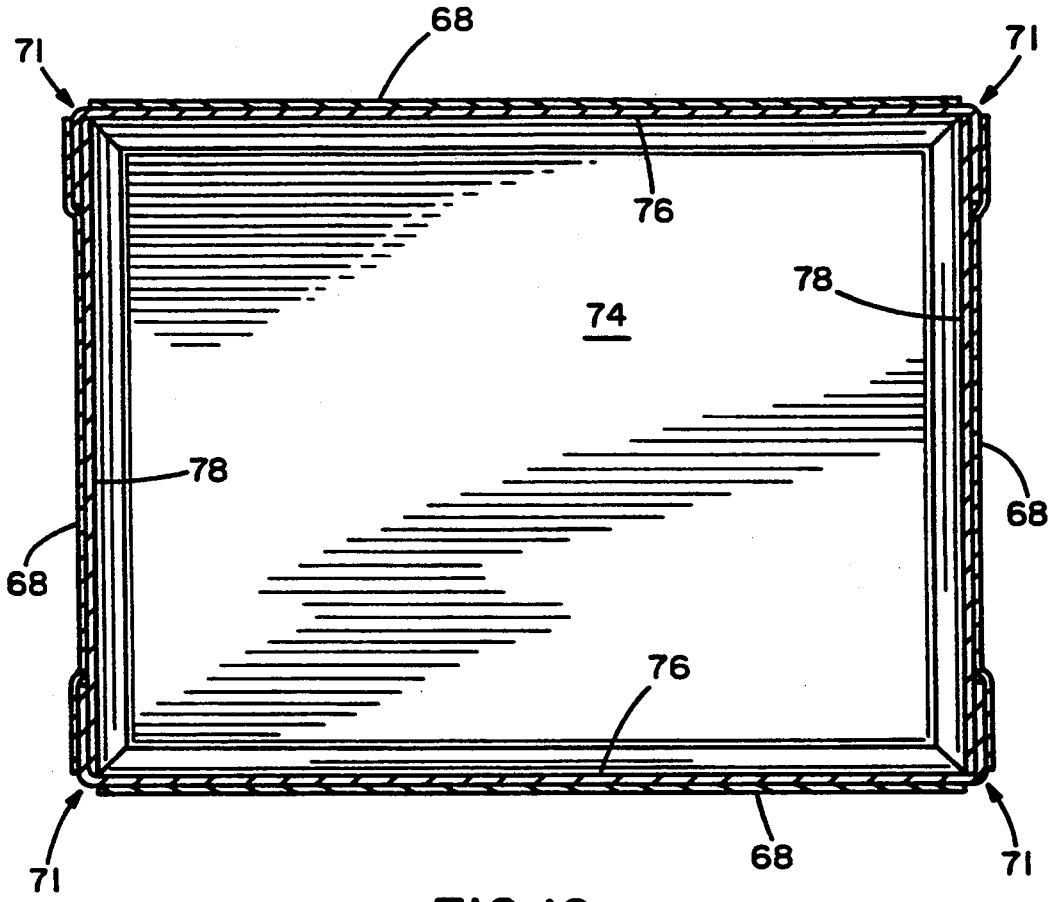
FIG. 16 is a sectional view of the package of FIG. 13, taken substantially along line 16—16 in FIG. 14.
Figure 17:
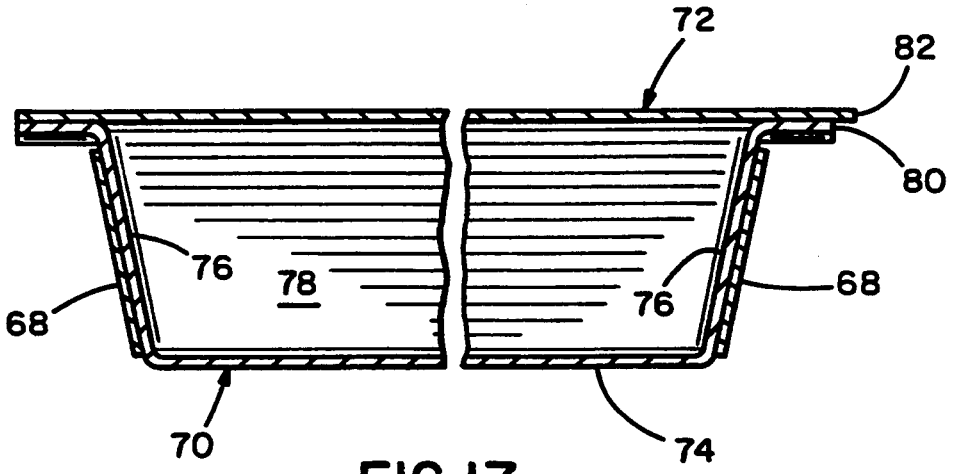
FIG. 17 is a foreshortened sectional view of the package of FIG. 13, taken substantially along line 17—17 in FIG. 14, shown on an enlarged scale.

In the first control experiment, probe 4 was observed to become disengaged from the surface of the food item, at a time of between 60 and 80 sec. Similarly, in the second control experiment, illustrated in FIG. 8, probe 4 became disengaged at a time of about 100 sec. The data generated by probe 4 in the controls after its disengagement does not reflect temperature in the food item, and is not comparable with data from the other probes. However, sufficient data was generated by the probes which remained in place, and by probe 4 prior to its disengagement, to support the conclusion that the device and method of the invention provide improved rate and uniformity of heating. FIGS. 9 and 10 show results obtained in two trials employing a substantially cylindrical wall made of aluminum foil as described above. FIGS. 11 and 12 illustrate results obtained using a mesh as described above. Particularly noteworthy are the differences in the temperature/time plot for probes 2 and 3, indicating a markedly higher rate of temperature increase at interior portions of the food item when methods and apparatus in accordance with the invention are employed.

In each of the experiments, heating of the pizza was terminated after 200 seconds. Observation of the food items indicated that they were fully cooked within shorter periods of time using the devices in accordance with the invention than in the control examples. Furthermore, while the crusts in the control examples were largely undercooked, as evidenced by a lack of crispness and lack of browning over substantial portions of the bottom of the pizza, the crusts in the examples employing the methods and apparatus of the invention were observed to be satisfactorily crisped and browned. The improved browning and crisping of the crust in a shorter period of time suggests that the devices and methods in accordance with the invention enhance susceptor performance in addition to increasing direct heating of the food item.

It has been observed that variation of dimensions of devices in accordance with the invention has resulted in variations in performance. It is believed that the variations in performance are due in part to resonances occurring at certain dimensions of the device. In particular, it is believed that improved performance is in some cases related to selection of the dimensions to achieve a resonance, i.e., generation of a standing wave of electromagnetic energy within the food item surrounded by the device, with nodes of the standing wave being substantially coincident with the upstanding wall while the food item remains in its frozen state. The standing wave is believed to be one component of a plurality of different modes of electromagnetic radiation in the cavity.

It is believed that advantages may also be obtained by generation of a standing wave pattern in the air above the food item within the device, again with one or more nodes of the standing wave being substantially coincident with the upstanding wall. In conventional microwave ovens sold in this country for consumer use, a magnetron is employed to emit microwave radiation at about 2.45 GHz. The wavelength of such radiation in air is approximately equal to the free space wavelength of such radiation, which is about 12.2 cm. It is believed that improved results may be obtained for certain food items where the device is dimensioned such that its major horizontal dimension is substantially equal to a half-integer multiple of the free space wavelength. In the case of a circular embodiment, the major horizontal dimension would be the diameter. In the case of a rectangular embodiment, the major horizontal dimension would be the length of the longer sides. Thus, for example, the device in its circular cylindrical embodiment might have a diameter equal to about 6.1 cm. or 18.3 cm. It should be noted that the standing wave pattern having a major dimension of 12.2 cm. would have a node at its center which would decrease the rate of heating at the center and, accordingly, decrease the effectiveness of the device. It has been found that devices of 12.2 cm. diameter provided improved heating, as compared with no reflective device, but that such improvement is not as great as the improvements at 6.1 cm. and 18.3 cm.

From the foregoing, it will be appreciated that the invention provides a novel and improved method and apparatus for enhancing microwave heating of food items. The invention is not limited to the embodiments described above or to any particular embodiments. The invention is described in the following claims.

What is claimed is:

1. A combination comprising a frozen food item and a device for enhancing microwave heating of said frozen food item in a microwave oven emitting microwave electromagnetic radiation at about 2.45 GHz, said frozen food item having a vertical dimension smaller than its horizontal dimensions;

said device comprising an upstanding wall composed of a microwave-reflective material closely surrounding said frozen food item;

said device defining a space bounded by said upstanding wall, said device effecting formation of an electromagnetic standing wave within the space bounded by said upstanding wall when excited by the electromagnetic radiation;

said device being dimensioned to provide for nodes of said standing wave to be substantially coincident with said upstanding wall while said frozen food item remains in its frozen state;

said frozen food item defining a characteristic wavelength for microwave radiation at 2.45 GHz within said frozen food item; and said space having a major horizontal dimension substantially equal to a half-integer multiple of said wavelength.

2. A combination in accordance with claim 1 wherein said device has a diameter of at least about 12.2 cm.

3. A combination in accordance with claim 1 wherein said device has a substantially circular configuration.

4. A combination in accordance with claim 1 wherein said device has a substantially frustoconical configuration, with said wall sloping inward at an angle of between about 2.5° and about 15°.

5. A method of enhancing microwave cooking of a frozen food item in a microwave oven cavity having means emitting microwave electromagnetic radiation at a frequency greater than 0.3 GHz, comprising the steps of:

placing an upstanding microwave-reflective wall closely about the food item in the microwave oven cavity to define a space bounded by said upstanding wall;

applying microwave energy to said frozen food item and said microwave-reflective wall to define a characteristic wavelength at a frequency of about 2.45 GHz;

and maintaining said upstanding microwave-reflective wall in place about said food item during application of microwave energy thereto, while maintaining space inward and above the upstanding microwave-reflective wall in the microwave oven cavity free of obstructions to microwave radiation, thereby effecting formation of an electromagnetic standing wave within the space bounded by said upstanding microwave-reflective wall with nodes of said standing wave substantially coincident with said upstanding wall, the space bounded by said upstanding wall having a major horizontal dimension substantially equal to a half-integer multiple of the characteristic wavelength of microwave energy in the food item.

6. A method in accordance with claim 5 wherein said microwave-reflective wall has a height of between 1 and 3 times a thickness of the food item.

7. A method in accordance with claim 5 wherein the microwave-reflective wall has a substantially circular-cylindrical configuration.

8. A method in accordance with claim 5 wherein the microwave-reflective wall has a substantially frustoconical configuration, with said wall sloping inward at an angle of less than about 15°.

9. A combination comprising a frozen food item and a package for enhancing microwave heating of said frozen food item in a microwave oven emitting microwave electromagnetic radiation to define a characteristic wavelength at about 2.45 GHz, said package comprising a top wall, a bottom wall and a plurality of side walls connecting said bottom wall and said top wall;

said package defining an interior space containing said frozen food item;

each of said top wall and said bottom wall being substantially transparent to microwave energy;

each of said side walls including a panel of microwave-reflective material;

said panels of microwave-reflective material improving uniformity of heating of said frozen food item when said frozen food item is subjected to the microwave electromagnetic radiation in said microwave oven; and said interior space bounded by said side walls including said panel of microwave-reflective material having major horizontal dimension substantially equal to a half-integer multiple of the characteristic wavelength defined by the food item.

10. A combination in accordance with claim 9 wherein each of said side walls comprises a non-metallic substrate with said panel of microwave-reflective material attached thereto.

11. A combination in accordance with claim 10 wherein substrates of said side walls are attached to one another.

12. A combination in accordance with claim 11 wherein said package is substantially rectangular in plan.

13. A combination in accordance with claim 12 wherein said side walls slope outward.

14. A combination in accordance with claim 13 wherein each of said panels of microwave-reflective material comprises aluminum foil.

15. A combination in accordance with claim 9 wherein said panels are separated from one another.

16. A method of enhancing microwave cooking of a frozen food item in a microwave oven cavity having means emitting microwave electromagnetic radiation comprising the steps of:

providing an upstanding microwave-reflective wall about the food item to define a space bounded by said upstanding wall;

said upstanding microwave-reflective wall comprising a plurality of separate panels of microwave-reflective material;

applying microwave energy at a frequency greater than 0.3 GHz to said frozen food item and said microwave-reflective wall to define a characteristic wavelength therebetween wherein the space bounded by the upstanding-reflective wall has a major horizontal dimension substantially equal to a half-integer multiple of the characteristic wavelength;

and maintaining said upstanding microwave-reflective wall in place about said food item during application of microwave energy thereto, while maintaining the space bounded by said upstanding wall and above and below the upstanding wall in the microwave oven cavity free of obstructions to microwave radiation.

17. A method in accordance with claim 16 wherein the step of providing an upstanding microwave-reflective wall about the food item comprises providing a package having a plurality of side walls, each of said side walls including a panel of microwave-reflective material, each of said panels being spaced from adjacent panels at opposite ends to provide gaps between adjacent panels.

18. A method in accordance with claim 17 wherein said package is substantially rectangular in plan.

19. A method in accordance with claim 18 wherein said each of said side walls slopes outward.

20. A method in accordance with claim 19 wherein said panels of microwave-reflective material comprise aluminum foil attached to exterior surfaces of said side walls.

* * * * *